US012302983B2

(12) United States Patent
Kajiwara et al.

(10) Patent No.: US 12,302,983 B2
(45) Date of Patent: May 20, 2025

(54) SOLE FOR A SHOE

(71) Applicant: MIZUNO Corporation, Osaka (JP)

(72) Inventors: Yo Kajiwara, Osaka (JP); Shunsuke Tazawa, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 18/511,544

(22) Filed: Nov. 16, 2023

(65) Prior Publication Data

US 2024/0164477 A1 May 23, 2024

(30) Foreign Application Priority Data

Nov. 18, 2022 (JP) ..... 2022-185125

(51) Int. Cl.
*A43B 13/14* (2006.01)
*A43B 5/06* (2022.01)
*A43B 13/18* (2006.01)

(52) U.S. Cl.
CPC ..... *A43B 13/18* (2013.01); *A43B 5/06* (2013.01); *A43B 13/14* (2013.01); *A43B 13/143* (2013.01); *A43B 13/148* (2013.01)

(58) Field of Classification Search
CPC ..... A43B 13/14; A43B 13/143; A43B 13/145; A43B 13/146; A43B 13/148
USPC ..... 36/25 R
See application file for complete search history.

(56) References Cited

U.S. PATENT DOCUMENTS 4,425,721 A * 1/1984 Spronken ..... A61F 13/045 36/86
5,491,909 A * 2/1996 Darby ..... A61F 5/0195 36/76 R
5,507,106 A * 4/1996 Fox ..... A43B 13/143 36/114
5,974,699 A * 11/1999 Park ..... A43B 13/148 36/103
6,260,289 B1 * 7/2001 Tsuji ..... A43B 13/145 36/31
2002/0157279 A1 * 10/2002 Matsuura ..... A43B 13/143 36/103
2002/0178621 A1 * 12/2002 Darby ..... A43B 13/383 36/110
2006/0117603 A1 * 6/2006 Park ..... A43B 7/146 36/103
2009/0151201 A1 * 6/2009 Lee ..... A43B 21/26 36/76 R (Continued)

*Primary Examiner* — Marie D Bays
(74) *Attorney, Agent, or Firm* — CANTOR COLBURN LLP

(57) ABSTRACT

Path length L is a distance from the origin to the tip toe position along the sole top surface, intersection C is a point between the sole bottom surface and a line perpendicular to the reference line S through the position of 0.45 L, and intersection D is a point between the sole bottom surface and a line perpendicular to the reference line S through the position of 0.60 L. In a sole stable posture in which the sole is in contact with the ground at points C and D, the sole bottom surface is separated from the ground at the heel and tip toe portions. Inequality, θ≥5 degrees is satisfied in the sole stable posture, wherein θ is an angle between the ground and a line connecting the heel central position of 0.15 L and the metatarsophalangeal joint position of 0.68 L.

3 Claims, 15 Drawing Sheets

(56) References Cited

U.S. PATENT DOCUMENTS

| | | | | |
|---|---|---|---|---|
| 2009/0183393 | A1* | 7/2009 | Lee | A43B 21/28 36/43 |
| 2011/0067267 | A1* | 3/2011 | Lubart | A43B 3/0073 36/43 |
| 2012/0023774 | A1* | 2/2012 | Garcia | A43B 13/148 36/31 |
| 2012/0151796 | A1* | 6/2012 | Diard | A43B 13/04 36/83 |
| 2013/0145653 | A1* | 6/2013 | Bradford | A43B 13/42 36/103 |
| 2014/0290097 | A1* | 10/2014 | Bann | A43B 13/04 36/102 |
| 2016/0345668 | A1* | 12/2016 | Dyer | A43B 13/186 |
| 2020/0022452 | A1* | 1/2020 | Hatano | A43B 13/181 |
| 2021/0169173 | A1* | 6/2021 | Oleson | A43B 13/141 |
| 2022/0104581 | A1* | 4/2022 | Sakaguchi | A43B 13/141 |

* cited by examiner

SOLE FOR A SHOE

CROSS REFERENCE TO RELATED APPLICATION

This application is related to and claims the benefit of Japanese Patent Application Number JP2022-185125 filed on Nov. 18, 2022, the contents of which are herein incorporated by reference in their entirety.

BACKGROUND OF THE INVENTION

The present invention relates generally to a sole for a shoe, and more particularly, to an improvement of a sole structure that can completely support a phase from a ground contact to a start of a heel elevation to promote a forefoot running in a more natural and further sustainable manner during running.

Recently, when running efficiently in a long-distance race, a forefoot running style that impacts the ground at a fore foot region of a foot has become a mainstream. The forefoot running style has merits that it can reduce the burden on a knee and shorten a ground-contact time to ease the burden on muscles. It is considered that an efficient movement can be attained and a superior running economy can be achieved by skillfully utilizing springy behaviors of an Achilles tendon and calf muscles, i.e. expansion/contraction of the Achilles tendon and contraction/relaxation of the calf muscles, during the forefoot running. Here, the term, "running economy" is an index showing how one can run at a certain speed zone with less energy (or less oxygen consumption). As the running economy is superior or high, the oxygen consumption is small and thus an efficient running can be achieved.

However, it requires not less than a certain degree of skill to acquire such a forefoot running. Specifically, firstly, a contact skill is necessary to allow for a forefoot/midfoot contact with the ground in a phase immediately before a ground contact. Secondly, a leg strength (or muscular strength and endurance) is necessary to restrain a falling (or sinking/dropping) of a heel to withstand stretching of tendon of muscles in a phase of the ground contact. Finally, a lock of an ankle is necessary. Therefore, it was not easy for a beginner runner to acquire the forefoot running. It mostly depends on an ability of a runner whether he/she can perform the forefoot running continuously.

Incidentally, a sole with a high-rigidity plate (e.g. CFRP (carbon fiber reinforced plastic) plate) incorporated therein has been provided for a practical use in order to support a heel during sinking of the heel. In such a sole, when a load is transferred to a forefoot portion, a forefoot area of the plate is pushed downwardly and thus a heel area of the plate is lifted upwardly through a seesaw action, thereby supporting the heel.

However, since the sole incorporating such a plate is not so structured as to urge a forefoot running naturally as a single piece of sole, it was not sufficient for causing the forefoot running to be sustainable.

Therefore, to achieve the forefoot running, the applicant of the present application proposed a sole for a shoe disclosed in Japanese patent application publication No. 2020-163084 (see paragraphs [0020] to [0024], [0028] to [0030] and FIG. 9). In this sole, inequalities, m2≥m1, m1≥f and m1≥h are satisfied, wherein a position of a rearmost end of a foot-sole-contact-side surface is designated as the origin of a coordinate, a path length measured along the foot-sole-contact-side surface of the sole from the origin to a position of a tip of a toe is designated as L, in a state that the foot-sole-contact-side surface at a heel region is arranged parallel to a horizontal plane, a sole thickness at position Sh of 0.16×L from the origin is h, a sole thickness at position Sm2 of (0.3–0.5)×L from the origin is m2, a sole thickness at position Sm1 of (0.4–0.6)×L from the origin is m1 provided that the position Sm1 is disposed in front of the position Sm2, and a sole thickness at position Sf of 0.7×L from the origin is f. Also, another inequality, θ2≥θ1 is satisfied, wherein an angle between a line connecting the positions Sm1 and Sh and the horizontal plane is θ1, a position where a vertical line drawn from the position Sm1 crosses a ground-contact surface is Sm1', a position where a vertical line drawn from the position Sh crosses the ground-contact surface is Sh', and an angle between a line connecting the positions Sm1' and Sh' and the horizontal plane is θ2. Furthermore, the ground-contact surface has a downwardly convexly curved shape at a forefoot region.

According to the sole described in the above-mentioned publication, the sole thickness h at the position Sh of 0.16×L from the origin is smaller than the sole thickness m1 at the position Sm1 of (0.4–0.6)×L from the origin, and besides, the angle θ2 between the line connecting the positions Sm1' and Sh' and the horizontal plane is greater than the angle θ1 between the line connecting the positions Sm1 and Sh and the horizontal plane. Thereby, at the time of striking onto the ground, the heel portion does not contact the ground, thus not causing a heel strike, thereby promoting a forefoot contact with the ground on landing. Also, the sole thickness m2 at the position of Sm2 is greater than the sole thickness m1 at the position of Sm1, such that thereby when an initial contact with the ground occurs at the position Sm1' on the sole ground-contact surface, the sole is prevented from leaning rearwardly and thus the heel is restricted from sinking downwardly, thus promptly moving onto a forward rolling of the sole after the initial contact with the ground. Furthermore, the sole thickness f at the position of 0.7×L from the origin is smaller than the sole thickness m1 at the position Sm1, and besides, the sole ground-contact surface has a downwardly convexly curved shape at the forefoot portion, thereby achieving a smooth forward rolling of the sole.

Through present inventors' further intensive researches on the sole to achieve a forefoot running, the following facts have become evident:

When focusing on a first half of phase from an initial contact to the start of a heel elevation during running, it depends on a runner whether the sole inclines forwardly (i.e. rolls) or inclines rearwardly (i.e. rolls) at the initial contact. When the sole inclines rearwardly, the heel falls downwardly, such that thereby a motion of returning the center of gravity (which was transferred to the heel side) to the forefoot side is required. As a result, not only a time loss and a power loss will occur but also a foot posture will be deformed or collapsed to give a discomfort to the runner to, thus resulting in a foot fatigue.

Therefore, a prior-art sole is not enough to allow more people to feel a forefoot running. It is found that there is a room for further improvement in the above-mentioned sole to completely support a forefoot running in a more natural and further sustainable manner during running.

The present invention has been made in view of these circumstances and its object is to provide a sole for a shoe that can completely support a phase from a ground contact to a start of a heel elevation to promote a forefoot running in a more natural and further sustainable manner during running.

Other objects and advantages of the present invention will be obvious and appear hereinafter.

SUMMARY OF THE INVENTION

A sole for a shoe according to the present invention extends from a heel region through a midfoot region and a forefoot region to a toe portion and has a sole upper surface and a sole lower surface. A straight line connecting a position of a rearmost end of the sole upper surface and a position of a tip of the toe portion is designated as a reference line S, the position of the rearmost end of the sole upper surface is designated as the origin O of a coordinate, a path length measured along the sole upper surface from the origin O to the position of the tip of the toe portion is designated as L, an intersection between the sole lower surface and a line perpendicular to the reference line S through a position of 0.45×L along the sole upper surface from the origin O is designated as point C, and another intersection between the sole lower surface and another line perpendicular to the reference line S through a position of 0.60×L along the sole upper surface from the origin O is designated as point D. A sole posture with the sole in contact with the ground at points C and D is defined as a sole stable posture. The sole lower surface at the heel portion and the toe portion is separated from the ground in the sole stable posture. An inequality, $\theta \geq 5$ degrees is satisfied in the sole stable posture, in which an angle between the ground and a line connecting a heel central position of 0.15×L from the origin O along the sole upper surface and a metatarsophalangeal joint position of 0.68×L from the origin O along the sole upper surface is designated as θ.

According to the present invention, at the time of a ground contact of the sole with the ground, since the sole contacts the ground at two points, that is, at point C corresponding to the position of 0.45×L from the origin O and point D corresponding to the position of 0.60×L from the origin O, sinking of the sole toward the heel side after the ground contact is prevented and thus a stable sole posture can be attained, thereby eliminating a time loss and a power loss.

To the contrary, in the case of a sole that contacts the ground at a single point, it may be able to restrain a heel sinking to the minimum but it generates a certain amount of heel sinking, thereby causing a time loss and a power loss will arise.

Also, according to the present invention, since the sole lower surface at the heel portion and the toe portion is separated (i.e. floated) from the ground in the sole stable posture, an unintentional heel contact with the ground can be prevented at the time of the ground contact. Moreover, according to the present invention, the line connecting the heel central position and the metatarsophalangeal joint position forms an angle of 5 degrees or more relative to the ground in the sole stable posture, thereby allowing for a heel-up condition in which the heel portion is disposed above the forefoot portion, thus corresponding to a forefoot posture.

As stated above, according to the present invention, at the time of contacting the ground, a stable sole posture (or sole stable posture) can be achieved with the forefoot posture maintained, such that thereby a runner can realize a stable ground-contact easily during a forefoot running and can perform a forward rolling readily, thus moving onto a start of a heel elevation comfortably and efficiently after a ground contact. In such a manner, a phase from the ground contact to the start of the heel elevation can be completely supported to promote a forefoot running in a more natural and further sustainable manner during running.

Points C and D may be disposed at least at lateral side edge portions of the sole lower surface.

In the sole stable posture, the sole lower surface may be separated from the ground in a rearward region extending rearwardly from the position of 0.25×L from the origin O along the sole upper surface and in a forward region extending forwardly from the position of 0.80×L from the origin O along the sole upper surface.

A region extending from point C to point D at the sole lower surface may constitute a flat-shaped stable region and the flat-shaped stable region may be in contact with the ground in the sole stable posture. In this case, since the flat-shaped stable region extending from point C to point D acts as a support base area of the sole at the ground contact, a sole posture can be further stabilized at the ground contact thus further stabilizing the forefoot posture.

The sole may be in contact with points C, D and point E in the sole stable posture, wherein an intersection between the sole lower surface and a line extending perpendicularly to the reference line S through a position of 0.70×L from the origin O along the sole upper surface is designated as point E.

In this case, when the sole contacts the ground, since the sole comes into contact with the ground at three points, that is, points C and D and also point E in front of points C and D, a further stable sole posture can be attained and a forefoot posture can thus be more stabilized.

Point E may be disposed at a medial side edge portion of the sole lower surface and points C and D may be disposed at least at a lateral side edge portion of the sole lower surface.

In this case, when the sole contacts the ground, since the sole comes into contact with the ground at three points, i.e., points C and D at the lateral side edge portion and also point E at the medial side edge portion, that is, three points to form a triangle, a still further stable sole posture can be attained and a forefoot posture can thus be still more stabilized.

A region extending from point C to point D at the lateral side edge portion of the sole lower surface may constitute a flat-shaped lateral-side stable region, point C may be further disposed at the medial side edge portion of the sole lower surface, a region extending from point C to point D at the medial side edge portion of the sole lower surface may constitute a flat-shaped medial-side stable region, and the flat-shaped medial-side stable region and the flat-shaped lateral-side stable region may be in contact with the ground in the sole stable posture.

In this case, since the sole comes into contact with the ground at a wider contact area on the medial and lateral sides, a still further stable sole posture can be attained and a forefoot posture can thus be still more stabilized.

The sole may further include a curved plate provided in the sole and extending curvedly and continuously. The curved plate may at least extend from the heel central position to a region of the metatarsophalangeal joint. In this case, an elevation of the heel portion can be promoted at the time of a weight transfer to the toe portion to support a propulsion during running.

As above-mentioned, according to the present invention, a phase from the ground contact to the start of the heel elevation can be completely supported to promote a forefoot running in a more natural and further sustainable manner during running.

BRIEF DESCRIPTION OF THE DRAWINGS

For a more complete understanding of the invention, reference should be made to the embodiments illustrated in greater detail in the accompanying drawings and described below by way of examples of the invention.

DETAILED DESCRIPTION OF THE PREFERRED EMBODIMENTS

The present invention will now be described in detail with reference to embodiments thereof as illustrated in the accompanying drawings.

First Embodiment

Figure 1:
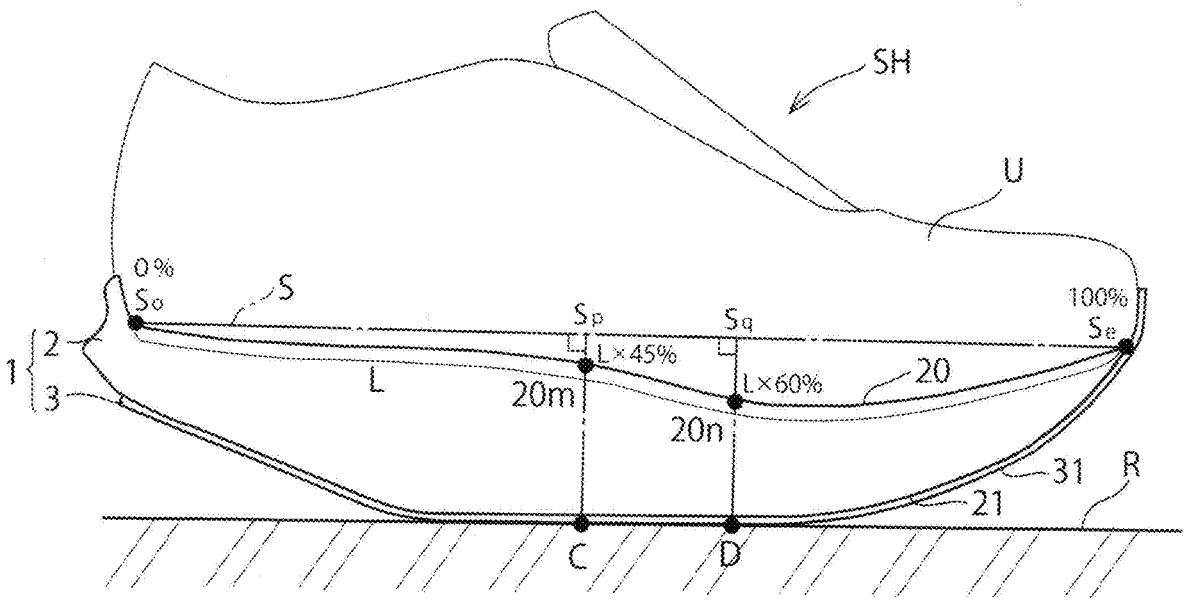
FIG. 1 is a side schematic view of a shoe employing a sole according to an embodiment of the present invention.
Figure 2:
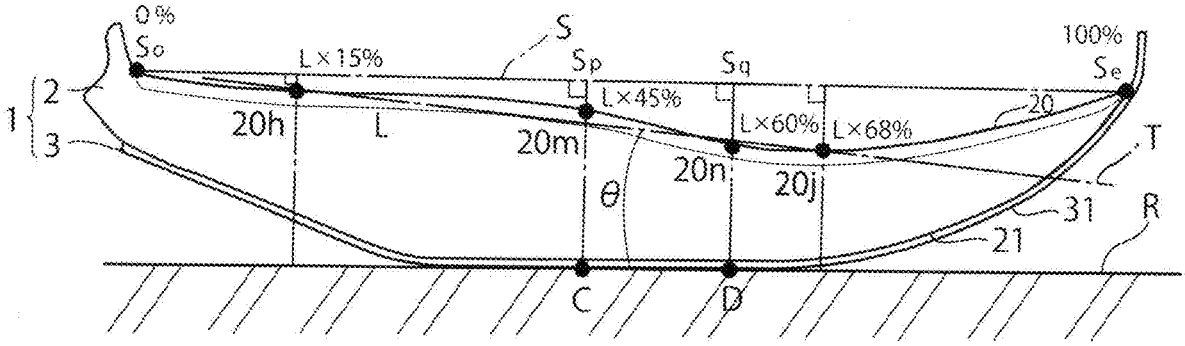
FIG. 2 is a side schematic view of the sole of FIG. 1.
Figure 3:
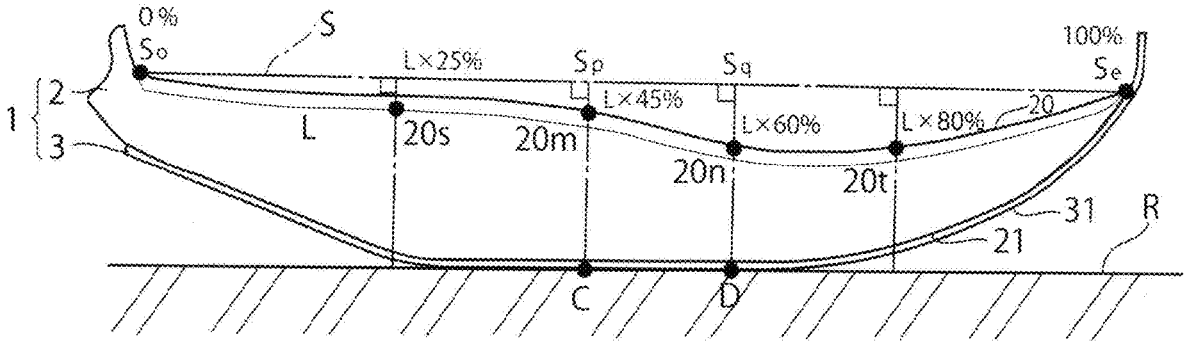
FIG. 3 is a side schematic view of the sole of FIG. 1.
Figure 4:
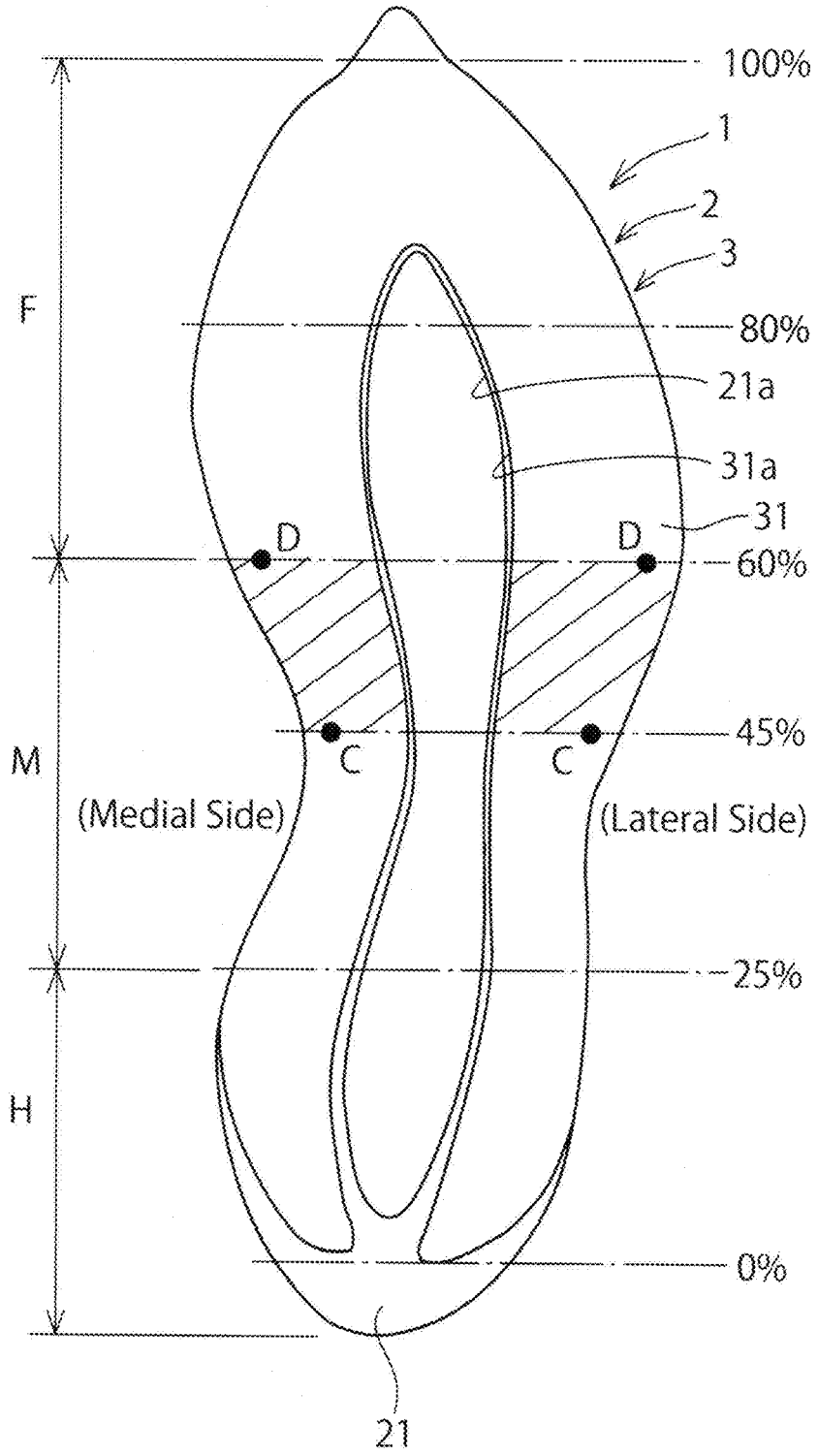
FIG. 4 is a bottom schematic view of the sole of FIG. 1.
Figure 5:
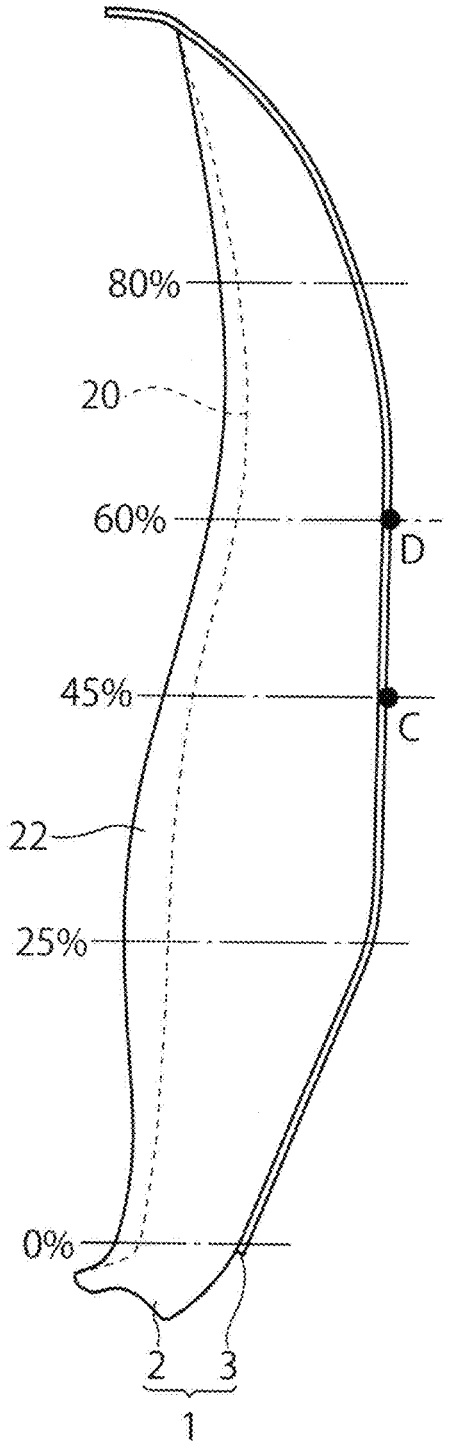
FIG. 5 is a medial-side schematic view of the sole of FIG. 4.
Figure 6:
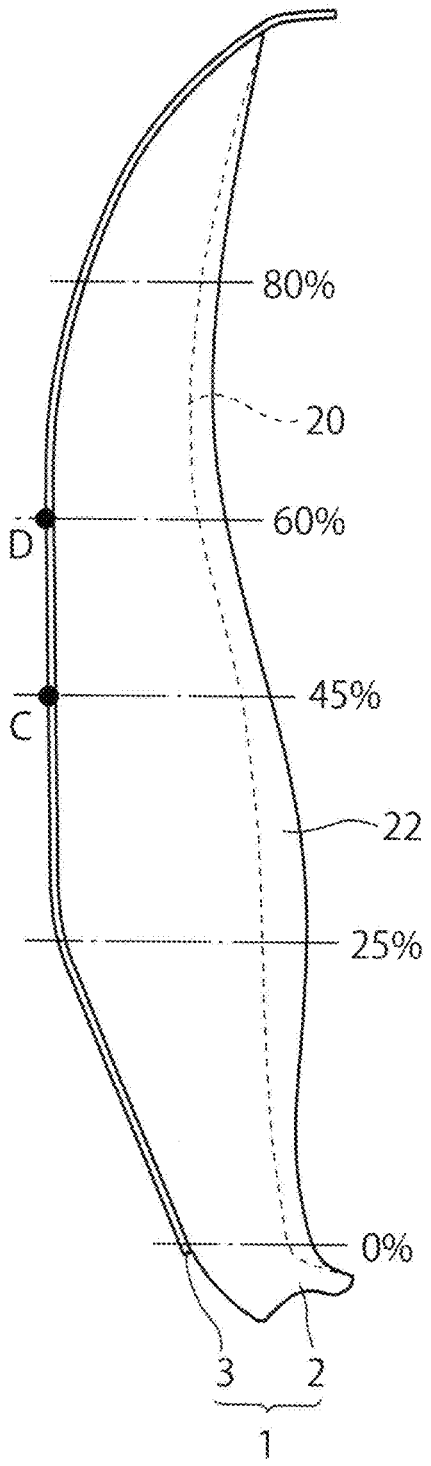
FIG. 6 is a lateral-side schematic view of the sole of FIG. 4.
Figure 7:
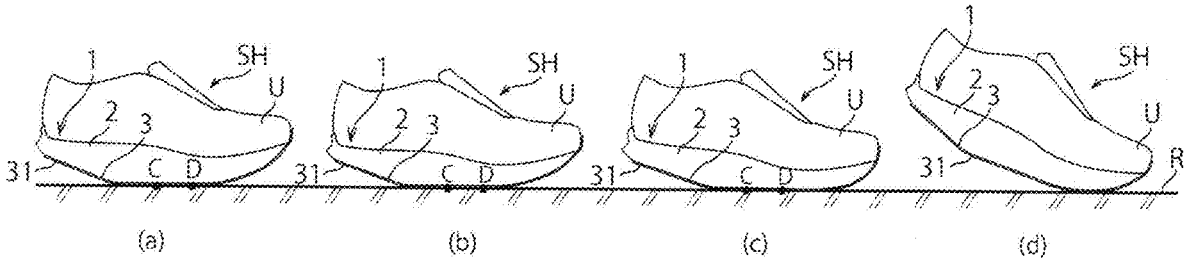
FIG. 7 shows the state of the shoe of FIG. 1 during running, illustrating the motion of the shoe relative to the ground in order of (a) to (d) in time-series manner.

FIGS. 1 to 8 show a sole and a shoe incorporating the sole according to a first embodiment of the present invention. In those drawings, FIG. 1 illustrates an external appearance of the shoe; FIGS. 2-3 and 5-6 side schematic views of the sole; FIG. 4 a bottom schematic view of the sole; FIG. 7 the state of the shoe during running in time-series manner; and FIG. 8 the state of a prior-art shoe during running in time-series manner in comparison with the sole of FIG. 7. Here, an athletic shoe, especially, a running shoe for a middle to long distance is taken for an example as a shoe.

In the following explanation (the same is applicable to the following second to fourth embodiments), "upward (upper side/upper)" and "downward (lower side/lower)" designate an upward direction and a downward direction, or vertical direction, of the shoe, respectively, "forward (front side/front)" and "rearward (rear side/rear)" designate a forward direction and a rearward direction, or longitudinal direction, of the shoe, respectively, and "a width or lateral direction" designates a crosswise direction of the shoe.

For example, in FIG. 1, a side schematic view of the shoe, "upward" and "downward" designate "upward" and "downward" in FIG. 1, respectively, "forward" and "rearward" designate "right to left direction" in FIG. 1, and "a width direction" designates "out of the page" and "into the page" of FIG. 1. Similarly, in FIG. 4, for example, a bottom schematic view of the sole, "upward" and "downward" designate "into the page" and "out of the page" of FIG. 2, respectively, "forward" and "rearward" designate "upward" and "downward" in FIG. 2, respectively, and "a width direction" designates "left to right direction" in FIG. 2.

As shown in FIG. 1, Shoe SH comprises a sole 1 and an upper U provided on the sole 1 and fixedly attached to the sole 1 through bonding, sewing or the like. The sole 1 includes a midsole 2 disposed on an upper side of the sole 1 and an outsole 3 disposed below the midsole 2. An upper-side surface (i.e. sole top surface) 20 of the sole 1 forms a foot-sole-contact surface 20 of the midsole 2. A lower-side surface (i.e. sole bottom surface) 31 of the sole 1 forms a ground-contact surface 31 of the outsole 3. The outsole 3 is fixedly attached to a bottom surface 21 of the midsole 2 vie bonding or the like. The midsole 2 and the outsole 3 extend longitudinally from the heel portion (or a left end portion of FIG. 1) of the sole 1 to the toe portion (or a right end portion of FIG. 1).

The midsole 2 is preferably formed of a soft elastic material, more specifically, thermoplastic synthetic resin and its foamed resin such as ethylene-vinyl acetate copolymer (EVA) or the like, thermosetting synthetic resin and its foamed resin such as polyurethane (PU) or the like, alternatively, rubber material and foamed rubber such as butadiene rubber, chloroprene rubber or the like. The outsole 3 is preferably formed of a hard elastic material, more specifically, thermoplastic resin such as thermoplastic polyurethane (TPU), polyamide elastomer (PAE) and the like, thermosetting resin such as epoxy resin and the like, or solid rubber. In addition, materials for the midsole 2 and the outsole 3 are not limited to the above-mentioned materials. Any other suitable materials may be adopted.

As shown in FIGS. 1 and 2, a reference line S is designated as a straight line that connects a toe-tip position Se and a rearmost end position (or heel rear end) $S_0$ of the sole top surface 20. Here, the sole top surface 20 coincides with a shape of a bottom surface of a last in use for assembly of the shoe SH. Then, the rearmost end position $S_0$ is set to the origin O, a path length measured along the sole top surface 20 from the origin O to the toe-tip position Se is set to L. An intersection of the sole bottom surface 31 and a line crossing position 20*m* of (0.45×L) from the origin O along the sole top surface 20 and orthogonal to the reference line S is set to position C, and another intersection of the sole bottom surface 31 and a line crossing position 20*n* of (0.60×L) from the origin O along the sole top surface 20 and orthogonal to the reference line S is set to position D. In FIGS. 1 and 2, an intersection of the reference line S and a line crossing the position 20*m* and orthogonal to the reference line S is designated as point Sp, and an intersection of the reference line S and a line crossing the position 20*n* and orthogonal to the reference line S is designated as point Sq.

When a sole posture in which the sole 1 is in contact with the ground R at points C and D is defined as a sole stable posture, the sole bottom surface 31 at the heel portion and the toe portion is separated (or floated) from the ground R in the sole stable posture.

Here, point D of the sole bottom surface 31, which is disposed below position 20*n* of (0.60×L) from the origin O along the sole top surface 20, corresponds to a position of hypothenar eminence (or near the base of a fifth toe) of a foot of a shoe wearer.

Also, as shown in FIG. 2, in the sole stable posture, an inequality, $\theta \geq 5$ [degrees] is satisfied, wherein an angle (acute angle) between the ground R and a straight-line T connecting the heel central position 20*h* of (0.15×L) from the origin O with the metatarsophalangeal joint position 20*j* of (0.68×L) from the origin O along the sole top surface 20 is set to 8.

Preferably, as shown in FIG. 3, the sole bottom surface 31 is separated from the ground R at a rearward region (or a left-side region of FIG. 3) extending rearwardly from position 20*s* of (0.25×L) from the origin O along the sole upper surface 20. Position 20*s* generally corresponds to a foot joint position. More preferably, the sole bottom surface 31 is separated from the ground Rat a rearward region extending rearwardly from position of (0.27×L) (not shown) from the origin O along the sole top surface 20. This is for causing the heel portion not to contact the ground at the time of an initial contact of the sole 1. Also, at a forward region (or a right-side region of FIG. 3) extending forwardly from position 20*t* of (0.80×L) from the origin O along the sole top surface 20, the sole bottom surface 31 is separated from the ground R. Alternatively, at a forward region extending forwardly from the position of (0.81×L) (not shown) from the origin O along the sole top surface 20, the sole bottom surface 31 is separated from the ground R. This is for allowing for the toe portion to roll forwardly at the time of a load transfer to the toe portion.

As shown in FIG. 4, heel portion H, midfoot portion M and forefoot portion of the sole 1 are designated as follows (by using the path length L measured along the sole top surface 20 from the origin Oto the toe-tip end position Se):

i) Heel portion: 0 to (0.25×L) and the heel rear end edge portion ii) Midfoot portion: (0.25×L) to (0.60×L)

iii) Forefoot portion: (0.60×L) to (1.00×L)

In an example shown in FIG. 4, points C and D on the sole bottom surface (or the ground-contact surface of the outsole 3) 31 are respectively disposed at positions of (0.45×L) and (0.60×L) from the origin O on the lateral-side edge portion (including the position near the lateral-side edge portion) and the medial-side edge portion (including the position near the medial-side edge portion) of the outsole 31. Also, in the example of FIG. 4, there is formed a concavity 21*a* at the bottom surface of the midsole 2, which is generally centrally disposed in the width direction, extends in the longitudinal direction, and has a certain depth relative to the bottom surface of the midsole 2. The outsole 3 is disposed at a region except the concavity 21*a* on the bottom surface of the midsole 2 and has a cutout 31*a* corresponding to the concavity 21*a*.

As shown in FIG. 5 (a medial-side view of FIG. 4) and FIG. 6 (a lateral-side view of FIG. 4), the midsole 2 of the sole 1 has an upraised wall portion 22 that rises upwardly from the sole top surface (or the foot-sole-contact-side surface) 20. The upraised wall portion 22 is provided at an outer circumferential edge portion of the sole top surface 20 to encompass the sole top surface 20 along the outer circumferential edge portion of the sole top surface 20. In FIGS. 1-3, the upraised wall portion 22 is omitted.

Preferably, as shown in a hatched area of FIG. 4 and FIGS. 5 and 6, a region extending from the position of (0.45×L) to the position of (0.60×L) from the origin O at the sole bottom surface 31 is formed in a flat shape to constitute a sole stable area. In a sole stable posture in which the sole 1 is in contact with the ground R at points C and D, preferably, the entire hatched area (or sole stable area) of the sole bottom surface 31 is in contact with the ground R.

Then, effects of the present embodiment will be explained using FIG. 7.

FIG. 7(*a*) shows a phase at an initial ground contact of the sole 1. At this time, the sole 1 takes a sole posture in which the sole 1 comes into contact with the ground R at points C and D (see FIGS. 1-3) of the sole bottom surface 31, for example, at two points of the lateral-side points C and D (FIG. 4) of the sole bottom surface 31, maintaining a sole stable posture.

As set forth above, in the sole stable posture in which the sole 1 is in contact with the ground R at two points C and D, the sole bottom surface 31 is disposed separately (or floated) away from the ground R at the heel and toe portions. More preferably, at a rearward region extending rearwardly from the position of (0.25×L) (more preferably, (0.27×L)) from the origin O and a forward region extending forwardly from the position of (0.80×L) (more preferably, (0.81×L)) from the origin O, the sole bottom surface 31 is disposed separately (or floated) away from the ground R.

Thereby, at the initial ground contact, an unintentional ground contact of the heel portion can be prevented, a forefoot running can be naturally promoted, and a forefoot posture can be stabilized. Also, a rolling to the toe portion can be performed smoothly and the forefoot running can be more naturally promoted.

Moreover, in the sole stable posture, as referred to above, in FIG. 2, when the straight line connecting the heel central position 20*h* of (0.15×L) from the origin O with the metatarsophalangeal joint position 20*j* of (0.68×L) from the origin O along the sole top surface 20 forms angle θ relative to the ground R, an inequality, θ≥5 degrees is satisfied. Thereby, the heel portion can be disposed upward relative to the forefoot portion (that is, a heel-up state is attained), thus coinciding with a forefoot posture.

FIG. 7(*b*) shows a phase of an intermediate motion after the initial ground contact of the sole 1. As shown in FIG. 7(*b*), as a load is applied to the sole 1, the sole 1 is gradually compressed in an up-down direction, At this time, the sole 1 is in contact with the ground R at points C and D on the medial side of the sole bottom surface 31 as well as at points C and D on the lateral side of the sole bottom surface 31, thereby maintaining the stable posture of the sole 1 to hold the forefoot posture.

In such a manner, not only a natural support effect by the sole bottom surface 31 can be exerted but also sinking of the sole after the initial ground contact can be eliminated. As a result, a burden on a runner (that is, a burden on a muscle, etc. associated with a lift-up of the heel portion after sinking of the heel portion) caused by sinking of the heel portion can be reduced and running efficiency can be improved.

FIG. 7(*c*) shows a phase in which a maximum load is applied to the sole 1 after the initial ground contact of the sole 1. At this time, as shown in FIG. 7(*c*), the amount of compressive deformation of the sole 1 becomes the largest. Even in that case, the sole 1 maintains its contact state in which the sole 1 is in contact with the ground R at points C and D on the medial side of the sole bottom surface 31 as well as at points C and D on the lateral side of the sole bottom surface 31, thereby maintaining the stable posture of the sole 1 to hold the forefoot posture.

Then, FIG. 7(*d*) shows a phase after an elevation of the heel portion has started. At this time, as shown in FIG. 7(*d*), a contact area of the sole bottom surface 31 with the ground R is transferred to the side of the toe portion. In the phase of FIG. 7(*c*) immediately before the phase of FIG. 7(*d*), since a stable forefoot posture is maintained as the sole 1 is in contact with the ground R at points C and D, a transition to the phase of FIG. 7(*d*) from the state of FIG. 7(*c*) can be performed smoothly, such that thereby a runner can be led to the start of the elevation comfortably and efficiently during running.

Figure 8:
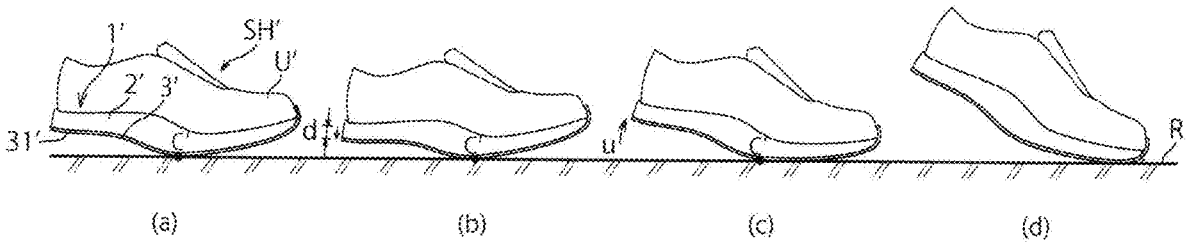
FIG. 8 shows the state of a prior-art shoe during running, illustrating the motion of the shoe relative to the ground in order of (a) to (d) in time-series manner.

Here, for comparison, FIG. 8 shows the state of a prior-art shoe during running. FIG. 8, similar to FIG. 7, illustrates the motion of the prior-art shoe relative to the ground in order of (a) to (d) in time-series manner. Phases (a)-(d) of FIG. 8 correspond to the respective phases (a)-(d) of FIG. 7, respectively. In addition, reference numbers like those in FIG. 7 indicate identical or functionally similar elements.

FIG. 8(*a*) shows a phase of an initial ground contact of the sole 1'. For comparison with the present embodiment, FIG. 8(*a*) shows the state in which the sole bottom surface 31' comes into contact with the ground R at point C' at the midfoot portion or the forefoot portion.

In the state in which the sole 1' is in contact with the ground R at point C' as shown in FIG. 8(*a*), the sole 1' is turnable or rotatable in both directions of a forward direction and a rearward direction. When the sole 1' rotates in the rearward direction, a forefoot posture is greatly collapsed, thus making it difficult to continue the forefoot running. Therefore, a runner's skill is required to rotate in the forward direction from the ground-contact state at point C'.

FIG. 8(*b*) shows a phase of an intermediate motion after the initial ground contact of the sole 1'. At this time, as shown in FIG. 8(*b*), the heel portion of the sole 1' falls down (or moves downwardly) toward the ground R by the amount of fall d.

Then, FIG. 8(*c*) shows a phase of lift-up of the heel portion after a maximum load is applied to the sole 1' subsequently to the initial ground contact of the sole 1'. In this case, since the amount of fall d of the heel portion is large in the phase of FIG. 8(*b*), the amount of lift-up u of the heel portion is large. Therefore, the sole 1' cannot move promptly from the phase of FIG. 8(*b*) to the phase of the lift-up of the heel portion shown in FIG. 8(*c*). As a result, a transfer from the heel portion to the forefoot portion after the ground contact cannot be performed in a smooth manner and thus a smooth transfer of the center of gravity from the heel portion to the toe portion cannot be achieved. Also, due to a large amount of fall d of the heel portion, a burden on a runner becomes large and a running efficiency cannot be improved.

FIG. 8(*d*) shows a phase after the start of elevation of the heel portion. At this time, a contact area of the sole bottom surface 31' with the ground R moves to the toe portion. In this case, since the amount of fall d of the heel portion is large and the burden on the runner is heavy before moving onto the phase of FIG. 8(*d*), it is difficult to lead the runner to the start of heel elevation comfortably and efficiently during running.

Second Embodiment

Figure 9:
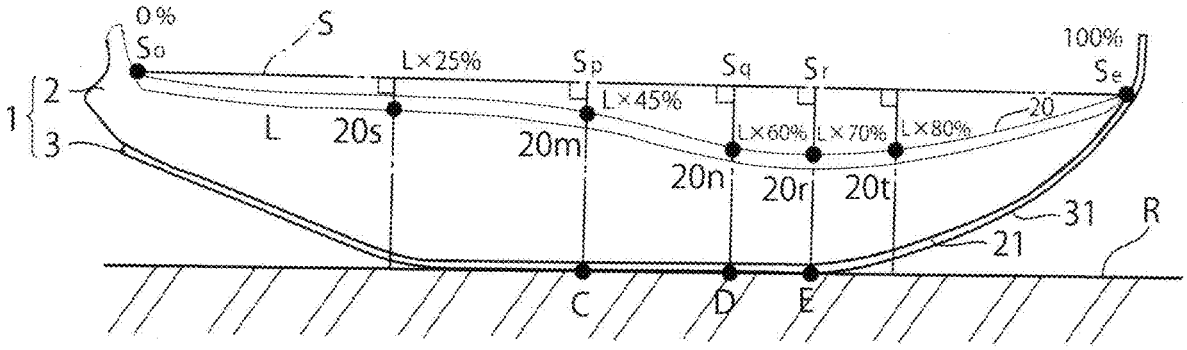
FIG. 9 is a side schematic view of a sole according to a second embodiment of the present invention.
Figure 10:
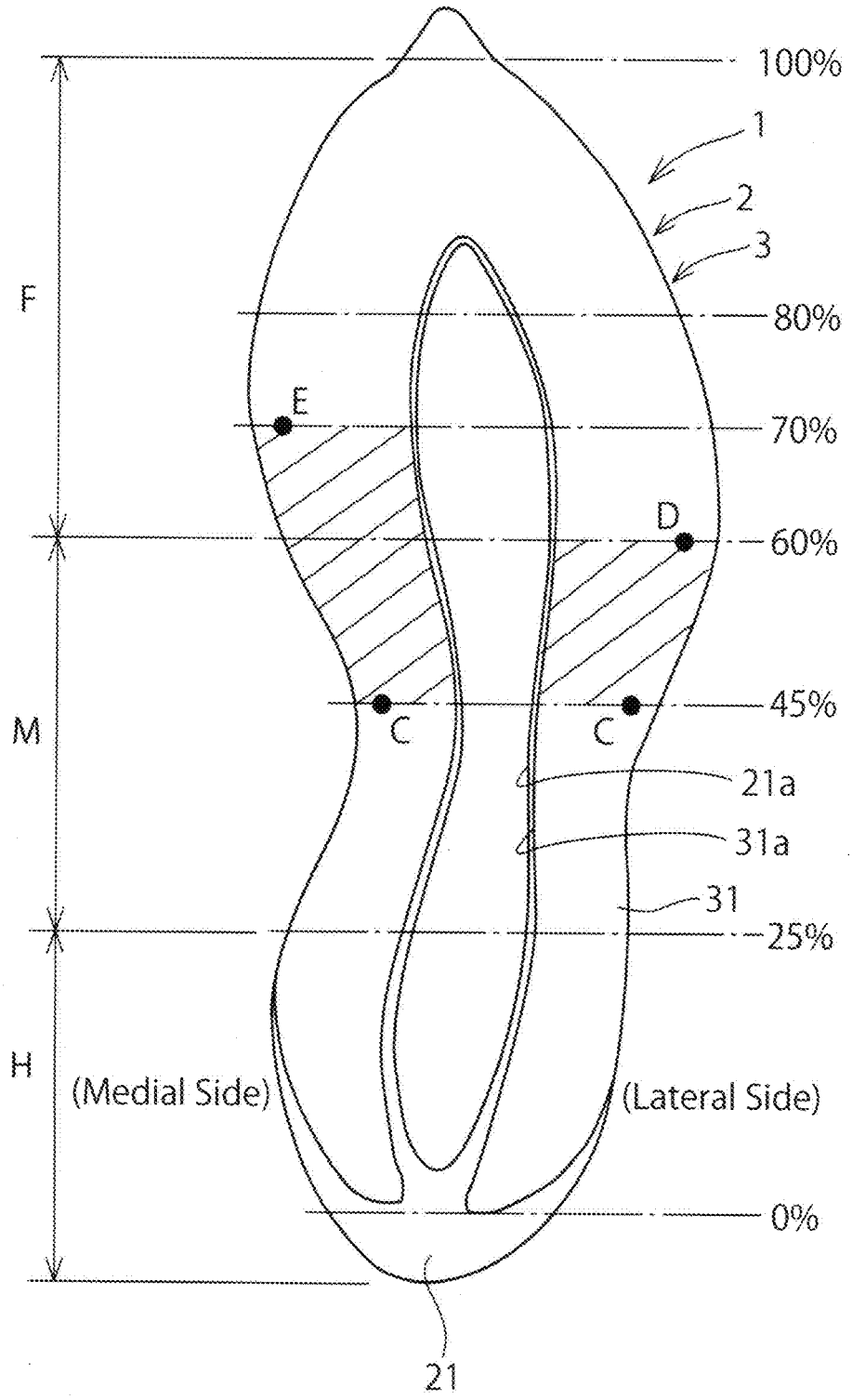
FIG. 10 is a bottom schematic view of the sole of FIG. 9.

FIGS. 9 and 10 show a sole according to a second embodiment of the present invention. In those drawings, FIG. 9 is a side schematic view of the sole and FIG. 10 is a bottom schematic view of the sole. FIGS. 9, 10 correspond respectively to FIGS. 3, 4 of the above-mentioned first embodiment. In the respective drawings, reference numbers like those in the first embodiment indicate identical or functionally similar elements.

As shown in FIG. 9, an intersection of the sole bottom surface 31 and a line perpendicular to the reference line S through position 20*r* of 0.70×L from the origin O along the sole upper surface 20 is designated as point E. In the drawing, an intersection of the reference line S and a line perpendicular to the reference line S through position 20*r* is shown by point Sr.

In a sole stable posture in which the sole bottom surface 31 is in contact with the ground R at points C and D, the sole bottom surface 31 is in contact with the ground R at point E as well. Also, in this sole stable posture, as with the first embodiment, the sole bottom surface 31 is separated (or floated) from the ground R at the heel portion and the toe portion.

Here, point E that is disposed on the sole bottom surface 31 and below position 20*r* of 0.70×L from the origin O along the sole upper surface 20 corresponds to the position of a ball of the foot (i.e. a bulged part at the base of a first toe) of a shoe wearer.

Also, similar to the aforesaid first embodiment, an inequality, $\theta \geq 5$ degrees is satisfied in the sole stable posture, wherein θ is an angle (acute angle) between the ground R and a line connecting the heel central position (not shown) of 0.15×L from the origin O along the sole top surface 20 with the metatarsophalangeal joint position (not shown) of 0.68×L from the origin O along the sole top surface 20.

Moreover, in the same manner as the first embodiment, preferably, at a rearward region (i.e. a left-side region in FIG. 9) extending rearwardly from the position 20*s* of (0.25×L) from the origin O along the sole top surface 20 and a forward region (i.e. a right-side region in FIG. 9) extending forwardly from the position 20*t* of (0.80×L) from the origin O along the sole top surface 20, the sole bottom surface 31 is separated (or floated) from the ground R.

Also, as shown in FIG. 10, point C on the sole bottom surface (or the ground-contact surface of the outsole 3) 31 is disposed at the lateral-side edge portion (including the position near the lateral-side edge portion) and at the medial-side edge portion (including the position near the medial-side edge portion) of the sole bottom surface 31 at the position of (0.45×L) from the origin O. Point D is disposed at the lateral-side edge portion (including the position near the lateral-side edge portion) of the sole bottom surface 31 at the position of (0.60×L) from the origin O. Point E is disposed at the medial-side edge portion (including the position near the medial-side edge portion) of the sole bottom surface 31 at the position of (0.70×L) from the origin O.

Preferably, as shown in a hatched area of FIG. 10, a region (including points C and D) extending from the position of (0.45×L) to the position of (0.60×L) from the origin O on the lateral side of the sole bottom surface 31 is formed in a flat shape to constitute a sole lateral-side stable area. In the sole stable posture in which the sole 1 is in contact with the ground Rat points C and D, preferably, the entire hatched area on the lateral side (or the entire sole lateral-side stable area) of the sole bottom surface 31 is in contact with the ground R.

Similarly, as shown in the hatched area of FIG. 10, a region (including points C and E) extending from the position of (0.45×L) to the position of (0.70×L) from the origin O on the medial side of the sole bottom surface 31 is formed in a flat shape to constitute a sole medial-side stable area. In a sole stable posture in which the sole 1 is in contact with the ground R at points C and E, preferably, the entire hatched area on the medial side (or the entire sole medial-side stable area) of the sole bottom surface 31 is in contact with the ground R.

In this second embodiment as well, similar to the aforesaid first embodiment, in the phase of the initial ground contact of the sole 1, for example, the sole 1 maintains the sole stable posture in which the sole 1 contacts the ground R at points C and D (FIG. 10) on the lateral side of the sole bottom surface 31. Also, at the heel portion and the toe portion, more preferably, at a rearward region extending rearwardly from the position of (0.25×L) from the origin O and a forward region extending forwardly from the position of (0.80×L) from the origin O, the sole bottom surface 31 is separated (floated) from the ground R. Therefore, at the initial ground contact, an unintentional ground contact of the heel portion can be prevented, a forefoot running can be naturally promoted, and a forefoot posture can be stabilized. Moreover, a rolling to the toe portion can be performed smoothly and the forefoot running can be more naturally promoted.

Also, in the sole stable posture, as with the above-mentioned first embodiment, when the straight line connecting the heel central position of (0.15×L) from the origin O with the metatarsophalangeal joint position of (0.68×L) from the origin O forms angle θ relative to the ground R, an inequality, θ≥5 degrees is satisfied. Thereby, the heel portion of the sole 1 can be disposed upward relative to the forefoot portion (that is, a heel-up state can be attained), thus coinciding with the forefoot posture.

Then, in a phase of an intermediate motion after the initial ground contact of the sole 1 and a phase of an application of a maximum load, similar to the aforesaid first embodiment, when the load is applied to the sole 1, the sole 1 is compressed in the up-down direction. At this time, not only a ground-contact state at points C and D on the lateral side of the sole bottom surface 31 is maintained but also a ground-contact state at points C and E on the medial side of the sole bottom surface 31 is maintained. Thereby, the sole 1 maintains a sole stable posture to hold a forefoot posture.

In such a way, not only a natural support function can be exerted by the sole bottom surface 31 but also a reduction of a fall of the heel portion after the initial ground contact can be achieved. As a result, a burden on a runner caused by sinking of the heel portion (that is, a burden on a muscle, etc. associated with lift-up of the heel portion after sinking of the heel portion) can be reduced and running efficiency can be improved.

Next, when moving onto the phase of the start of the elevation of the heel portion, similar to the first embodiment, since the stable forefoot posture is maintained, a transition to the phase of the start of the elevation can be smoothly conducted, thereby leading the runner to the start of the elevation comfortably and efficiently during running.

Third Embodiment

Figure 11:
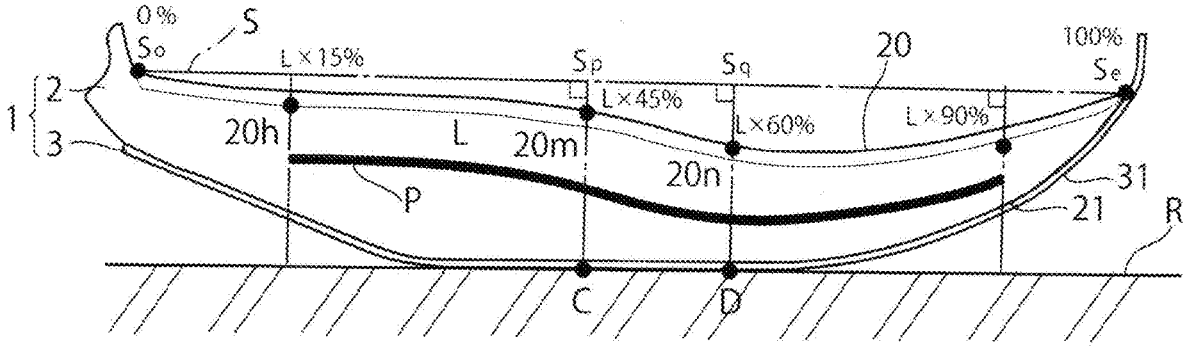
FIG. 11 is a side schematic view of a sole according to a third embodiment of the present invention.
Figure 12:
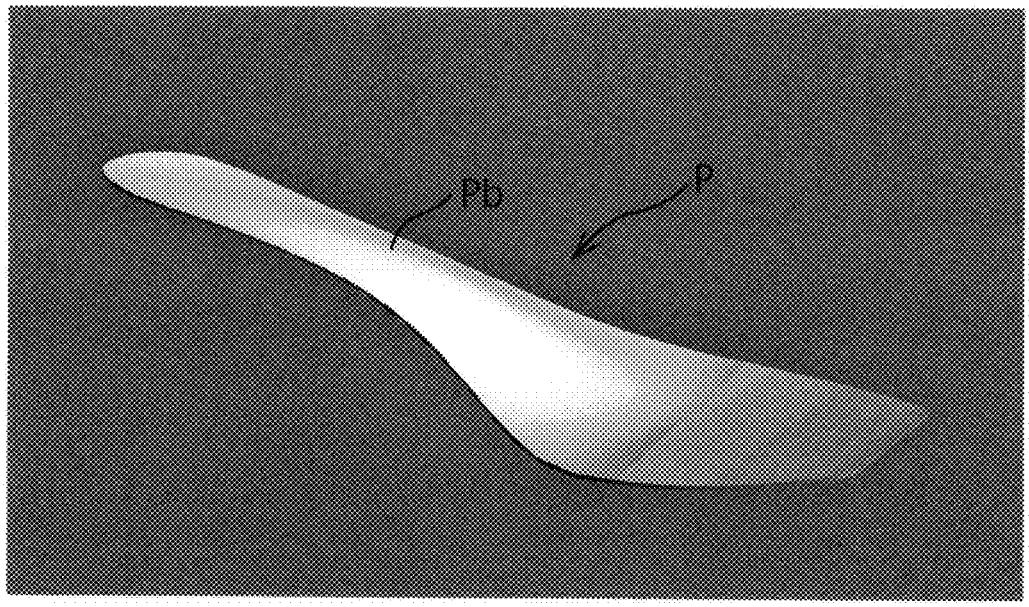
FIG. 12 is a general perspective view of a curved plate provided in the sole of FIG. 11, viewed from the above on the front side thereof.
Figure 13:
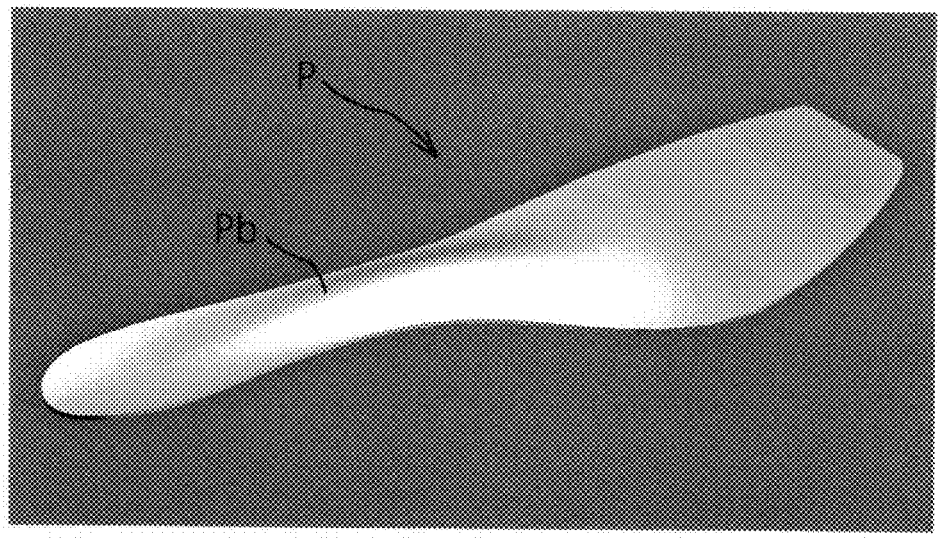
FIG. 13 is a general perspective view of the curved plate of FIG. 12, viewed from the above on the rear side thereof.
Figure 14:
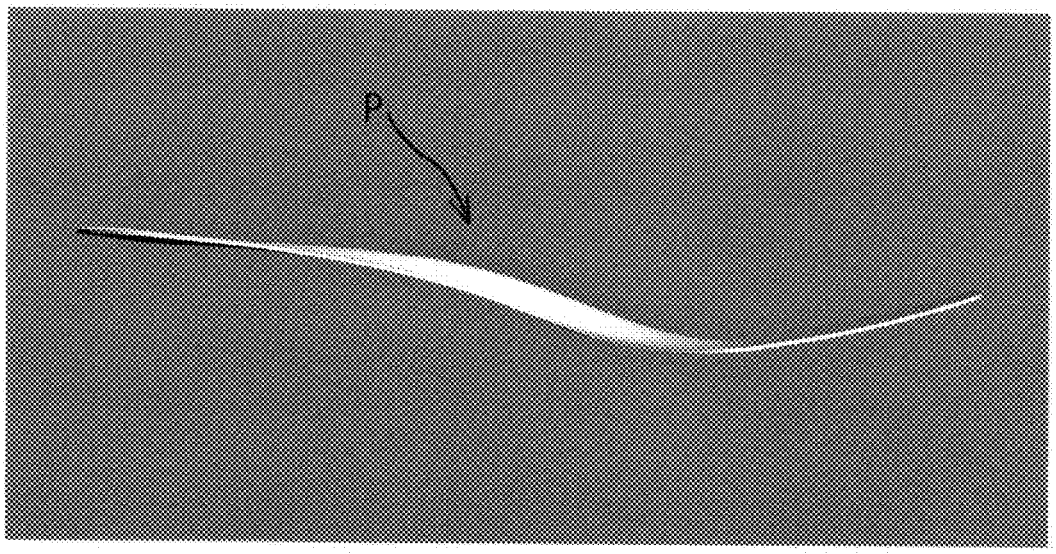
FIG. 14 is a side view of the curved plate of FIG. 12.

FIGS. 11-14 show a sole according to a third embodiment of the present invention. FIG. 11 is a side schematic view of the sole, and FIGS. 12-14 are external views of a curved plate to be provided at the sole. In those drawings, reference numbers like those in the aforesaid first and second embodiments indicate identical or functionally similar elements.

As shown in FIG. 11, in this third embodiment as well, similar to the first and second embodiments, in the sole stable posture in which the sole 1 is in contact with the ground R at points C and D, the sole bottom surface 31 is separated (or floated) from the ground at the heel portion and the toe portion, preferably, in a rearward region (or the left-side region of the drawing) extending rearwardly from the position (not shown) of (0.25×L) from the origin O along the sole top surface 20 and in a forward region (or the right-side region of the drawing) extending forwardly from the position (not shown) of (0.80×L) from the origin O along the sole top surface 20.

Also, as with the above-mentioned first and second embodiments, when the straight line connecting the heel central position **20*h* of (0.15×L) from the origin O along the sole top surface 20 with the metatarsophalangeal joint position (not shown) of (0.68×L) from the origin O along the sole top surface 20** forms angle (acute angle) θ relative to the ground R, in the sole stable posture, an inequality, θ≥5 degrees is satisfied.

As shown in FIG. 11, the third embodiment differs from the aforesaid first and second embodiments in that a curved plate P is provided inside the midsole 2 of the sole 1. The curved plate P extends continuously in the longitudinal direction and curvedly in the up-down direction (see FIGS. 12-14). Here, for illustration purposes, the curved plate P is shown in bold. Also, in this exemplification, a side surface of the curved plate P is visible from the side of the midsole 2, but unlike that, the curved plate P may be built-in inside the midsole 2 in such a way that the side surface of the curved plate P is not visible from the side of the midsole 2.

As shown in FIG. 11, the curved plate P extends longitudinally and curvedly at a region extending from the starting end or the heel central position **20*h* of (0.15×L) from the origin O to the terminal end or the position of (0.90×L) (i.e. the position in the vicinity of the toe portion) from the origin O. More specifically, the curved plate P extends forwardly from the position 20*h* linearly, or slightly curvedly in an upward convex shape and gently diagonally downwardly. The curved plate P changes its shape into a downward convex shape at or near the position 20*m*** and extends forwardly to the terminal end linearly, or slightly curvedly. The curved plate P has an elasticity in the up-down direction.

The curved plate P is a thin sheet-like member, and its thickness is for example, approximately 1 to 2 mm. The curved plate P is fitted into the midsole 2 through, for instance, insert molding. In addition, when the midsole 2 is formed of two layers of an upper midsole and a lower midsole, the curved plate P may be disposed between the boundary of the upper and lower midsoles.

The curved plate P may be formed of thermoplastic resin comparatively rich in elasticity such as thermoplastic polyurethane (TPU), polyamide elastomer (PAE), acrylonitrile butadiene styrene resin (ABS) and the like, alternatively, thermosetting resin such as epoxy resin, unsaturated polyester resin and the like. Also, as a material for the curved plate P, fiber reinforced plastics (FRP) may be adopted in which carbon fibers, aramid fibers, glass fibers or the like are incorporated as a strengthened fiber, and thermosetting resin or thermoplastic resin is incorporated as matrix resin.

As shown in FIGS. 12 and 13, the curved plate P may have a bulged portion (or a rib) Pb that bulges or protrudes upwardly in an arch-shape or a generally inverted V-shape and that extends longitudinally at a laterally and longitudinally central portion thereof.

In this third embodiment as well, as with the first embodiment, in a phase of an initial ground contact of the sole 1, a sole stable posture can be maintained in which the sole 1 is in contact with the ground R at points C and D, a forefoot posture can be stabilized, and a forefoot running can be naturally promoted. Also, in a phase of an intermediate motion after the initial ground contact and a phase of application of a maximum load, not only a natural support effect by the sole bottom surface 31 can be exerted but also sinking of the heel portion after the initial ground contact can be reduced.

In this case, since the curved plate P is provided in the midsole 2, a load to the heel portion of the sole 1 can be securely supported. Also, since the bulged portion Pb is provided at the curved plate P, the rigidity of the curved plate P is increased, thus supporting the load to the heel portion more securely.

Then, at the time of transition to the phase of the start of the heel elevation, similar to the first embodiment, since a stable forefoot posture is maintained, the transition to the phase of the start of elevation is performed smoothly, thereby leading the runner to the start of elevation comfortably and efficiently during running.

In this case, when a load is transferred to the forefoot portion of the sole 1, the runner steps on a forefoot area of the curved plate P, such that thereby a rear end side of the curved plate P is lifted upwardly through a "seesaw action", thus restricting a fall of the heel portion. In this fashion, a smooth transfer of the center of gravity toward the toe portion can be achieved. Also, in this case, since the curved plate P extends to a region near the toe, at the time of the push-off motion of the toe of the foot, by the action of an elastic repulsion of the curved plate P, the runner can kick the ground R strongly to obtain a driving force.

Fourth Embodiment

Figure 15:
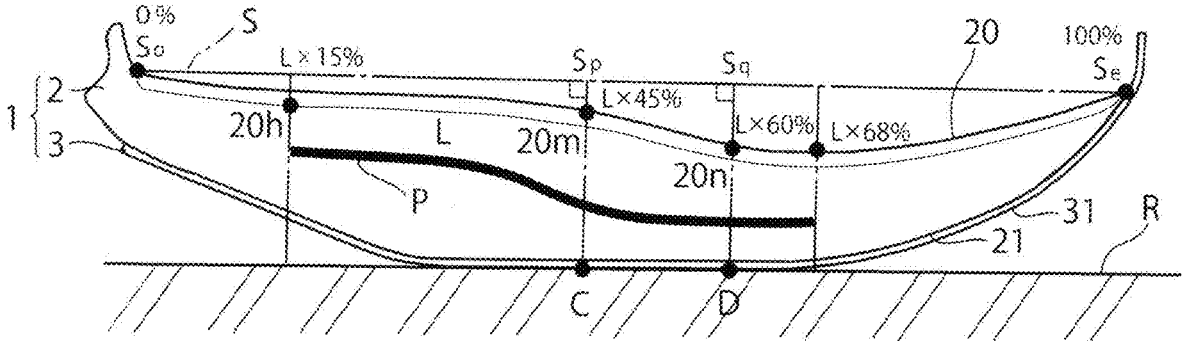
FIG. 15 is a side schematic view of a sole according to a fourth embodiment of the present invention.

FIG. 15 shows a sole according to a fourth embodiment of the present invention and is a side schematic view of the sole. In the drawing, reference numbers like those in the aforesaid first to third embodiments indicate identical or functionally similar elements.

In this fourth embodiment, similar to the third embodiment, the curved plate P is provided inside the midsole 2, but the length of the curved plate P is shorter than the length of the curved plate P of the third embodiment. More specifically, the position of a start end of the curved plate P is the same as that of the third embodiment, but a terminal end of the curved plate P is disposed at the position of (0.68×L) (i.e. the position of a metatarsophalangeal joint) from the origin O. That is, in this case, the curved plate P extends from the heel central position to the position of the metatarsophalangeal joint.

The fourth embodiment is similar to the third embodiment except that the curved plate P does not extend to the toe portion, and thus, the fourth embodiment has a similar effect to that of the third embodiment.

First Alternative Embodiment

In the above-mentioned first embodiment, an example was shown in which point C corresponding to the position of (0.45×L) from the origin O and point D corresponding to the position of (0.60×L) from the origin O are disposed at both the lateral side edge portion (including the position near the lateral side edge portion) and the medial side edge portion (including the position near the medial side edge portion), but the application of the present invention is not restricted to such an example.

Points C and D may be disposed at a slightly laterally inward position from the medial side edge portion and the lateral side edge portion, that is, at a position near the laterally central position. Alternatively, either one of points C and D may be disposed at the medial side edge portion or the lateral side edge portion, and the other of points C and D may be disposed at a slightly laterally inward position from the medial side edge portion and the lateral side edge portion.

Likewise, in the above-mentioned second embodiment, an example was shown in which point C is disposed at the medial and lateral side edge portions, point D is disposed at the lateral side edge portion, and point E corresponding to the position of (0.70×L) from the origin O is disposed at the medial side edge portion, but the application of the present invention is not restricted to such an example.

Point C may be disposed at a slightly laterally inward position from the medial and lateral side edge portions, point D may be disposed at a slightly laterally inward position from the lateral side edge portion, and point E may be disposed at a slightly laterally inward position from the medial side edge portion. Alternatively, either one or two of points C, D and E may be disposed at the medial and lateral side edge portions, and the other one or two of points C, D and E may be disposed at a slightly laterally inward position from the medial side edge portion and the lateral side edge portion.

Second Alternative Embodiment

In the aforesaid first embodiment, an example was shown in which the sole 1 contacts the ground R at points C and D on the lateral side at the time of the initial ground contact, and in a phase of an intermediate motion after the initial ground contact, the sole 1 contacts the ground R at four points of points C and D on the lateral side and points C and D on the medial side. However, in the phase of the intermediate motion, the sole 1 may contact the ground R at three points of points C and D on the lateral side and point D on the medial side, that is, three points constituting a triangle.

Similarly, in the aforesaid second embodiment, an example was shown in which the sole 1 contacts the ground R at points C and D on the lateral side at the time of the initial ground contact, and in a phase of an intermediate motion after the initial ground contact, the sole 1 contacts the ground R at four points of points C and D on the lateral side and points C and E on the medial side. However, in the phase of the intermediate motion, the sole 1 may contact the ground R at three points of points C and D on the lateral side and point E on the medial side, that is, three points constituting a triangle.

Third Alternative Embodiment

In the aforesaid first and second embodiments, an example was shown in which the lower surface of the midsole 2 is formed with a concave portion 21*a* and the outsole 3 is formed with a notch portion 31*a* corresponding to the concave portion 21*a*, but these concave portion 21*a* and the notch portion 31*a* may be omitted.

As mentioned above, the present invention is useful for a sole for a shoe that can completely support a phase from a ground contact to a start of a heel elevation to promote a forefoot running in a more natural and further sustainable manner during running.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole for a shoe, said sole extending from a heel region through a midfoot region and a forefoot region to a toe portion and having a sole upper surface and a sole lower surface, wherein a straight line connecting a position of a rearmost end of said sole upper surface and a position of a tip of said toe portion is designated as a reference line S, said position of said rearmost end of said sole upper surface is designated as the origin O of a coordinate, a path length measured along said sole upper surface from the origin O to said position of said tip of said toe portion is designated as L, an intersection between said sole lower surface and a line extending perpendicularly to said reference line S through a position of 0.45×L along said sole upper surface from the origin O is designated as point C, and another intersection between said sole lower surface and another line extending perpendicularly to said reference line S through a position of 0.60×L along said sole upper surface from the origin O is designated as point D, wherein a sole posture with said sole in contact with the ground at said points C and D is defined as a sole stable posture, wherein in said sole stable posture said sole lower surface at said heel portion and said toe portion is separated from the ground, wherein an inequality, $\theta \geq 5$ degrees is satisfied in said sole stable posture, in which an angle between the ground and a line connecting a heel central position of 0.15×L from the origin O along said sole upper surface and a metatarsophalangeal joint position of 0.68×L from the origin O along said sole upper surface is designated as θ, wherein an intersection between said sole lower surface and a line extending perpendicularly to said reference line S through a position of 0.70×L along said sole upper surface from the origin O is designated as point E, wherein points C and D are disposed at both a lateral side edge portion of said sole lower surface and said medial side edge portion of said sole lower surface, whereas point E is disposed at a medial side edge portion of said sole lower surface, and wherein a region that extends from point C to point D at said lateral side edge portion of said sole lower surface constitutes a flat-shaped lateral-side stable region, a region that extends from point C through point D to point E at said medial side edge portion of said sole lower surface constitutes a flat-shaped medial-side stable region, and said flat-shaped lateral-side stable region and said flat-shaped medial-side stable region are in contact with the ground in said sole stable posture.

2. The sole according to claim 1, wherein in said sole stable posture, said sole lower surface is separated from the ground in a rearward region that extends rearward from the position of 0.25×L along said sole upper surface from the origin O and in a forward region that extends forward from the position of 0.80×L along said sole upper surface from the origin O.

3. The sole according to claim 1 further comprising a curved plate provided in said sole and extending curvedly and continuously, wherein said curved plate at least extends from said heel central position to a region of said metatarsophalangeal joint.

* * * * *